US008682208B2

(12) United States Patent
Asaoka et al.

(10) Patent No.: US 8,682,208 B2
(45) Date of Patent: Mar. 25, 2014

(54) CLEANING DEVICE, IMAGE FORMING APPARATUS INCLUDING SAME, AND METHOD FOR MOUNTING SAME

(75) Inventors: Akira Asaoka, Kanagawa (JP); Takaya Muraishi, Kanagawa (JP); Kenji Sugiura, Kanagawa (JP); Hisashi Kikuchi, Kanagawa (JP); Yoshiki Hozumi, Kanagawa (JP); Yuu Sakakibara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 233 days.

(21) Appl. No.: 13/197,308

(22) Filed: Aug. 3, 2011

(65) Prior Publication Data

US 2012/0034006 A1 Feb. 9, 2012

(30) Foreign Application Priority Data

Aug. 9, 2010 (JP) ..... 2010-178346

(51) Int. Cl.
*G03G 15/16* (2006.01)

(52) U.S. Cl.
USPC ..... 399/101; 399/123; 399/343

(58) Field of Classification Search
USPC ..... 399/101, 123, 343
See application file for complete search history.

(56) References Cited

U.S. PATENT DOCUMENTS

| | | | | |
|---|---|---|---|---|
| 5,652,951 | A * | 7/1997 | Thayer et al. | 399/71 |
| 7,263,308 | B2 | 8/2007 | Harada et al. | |
| 7,496,324 | B2 | 2/2009 | Sugiura et al. | |
| 7,505,728 | B2 | 3/2009 | Yamaguchi et al. | |
| 7,603,071 | B2 | 10/2009 | Sugiura et al. | |
| 7,672,635 | B2 | 3/2010 | Hozumi et al. | |
| 7,680,446 | B2 | 3/2010 | Shintani et al. | |
| 7,711,308 | B2 | 5/2010 | Hozumi et al. | |
| 7,756,439 | B2 | 7/2010 | Kosuge et al. | |
| 7,809,321 | B2 | 10/2010 | Yano et al. | |
| 7,817,954 | B2 | 10/2010 | Yano et al. | |
| 7,835,683 | B2 | 11/2010 | Muraishi et al. | |
| 7,873,291 | B2 | 1/2011 | Kosuge et al. | |
| 7,873,298 | B2 | 1/2011 | Yamashita et al. | |
| 7,894,758 | B2 | 2/2011 | Shintani et al. | |
| 7,899,382 | B2 | 3/2011 | Hozumi et al. | |
| 7,899,383 | B2 | 3/2011 | Shintani et al. | |
| 7,903,995 | B2 | 3/2011 | Nakamatsu et al. | |
| 7,929,897 | B2 | 4/2011 | Sugimoto et al. | |
| 7,949,281 | B2 | 5/2011 | Muraishi et al. | |
| 2005/0152722 | A1 * | 7/2005 | Tawada et al. | 399/346 |
| 2005/0232667 | A1 * | 10/2005 | Iwata | 399/353 |
| 2006/0045603 | A1 * | 3/2006 | Hatori et al. | 400/693 |
| 2008/0193178 | A1 | 8/2008 | Sugimoto et al. | |
| 2008/0310897 | A1 | 12/2008 | Naruse et al. | |

(Continued)

FOREIGN PATENT DOCUMENTS

| | | |
|---|---|---|
| JP | 2003-216006 | 7/2003 |
| JP | 2007-25173 | 2/2007 |

*Primary Examiner* — David Gray
*Assistant Examiner* — Thomas Giampaolo, II
(74) *Attorney, Agent, or Firm* — Oblon, Spivak, McClelland, Maier & Neustadt, L.L.P.

(57) ABSTRACT

A cleaning device including: multiple cleaning members arranged consecutively in a direction of movement of a cleaning target to remove adhered substances from the cleaning target; multiple casings to individually hold and at least partially enclose the multiple cleaning members, respectively, the casings and the cleaning members together constituting multiple sub-units; and a sub-unit holder to hold the multiple sub-units, from which the sub-units are individually removable.

8 Claims, 6 Drawing Sheets

(56) References Cited

U.S. PATENT DOCUMENTS

| | | | |
|---|---|---|---|
| 2009/0035038 | A1 | 2/2009 | Sugimoto et al. |
| 2009/0123205 | A1 | 5/2009 | Watanabe et al. |
| 2009/0176669 | A1 | 7/2009 | Sugiura et al. |
| 2009/0185842 | A1 | 7/2009 | Hatori et al. |
| 2009/0252510 | A1 | 10/2009 | Shintani et al. |
| 2009/0311004 | A1 | 12/2009 | Naruse et al. |
| 2010/0008706 | A1 | 1/2010 | Sugiura et al. |
| 2010/0067945 | A1 | 3/2010 | Hozumi et al. |
| 2010/0067949 | A1 | 3/2010 | Watanabe et al. |
| 2010/0189461 | A1 | 7/2010 | Shintani et al. |
| 2010/0239302 | A1 | 9/2010 | Naruse et al. |
| 2011/0026992 | A1 | 2/2011 | Shintani et al. |
| 2011/0064433 | A1 | 3/2011 | Asaoka et al. |
| 2011/0085834 | A1 | 4/2011 | Naruse et al. |
| 2011/0158677 | A1 | 6/2011 | Kikuchi et al. |

* cited by examiner

CLEANING DEVICE, IMAGE FORMING APPARATUS INCLUDING SAME, AND METHOD FOR MOUNTING SAME

CROSS-REFERENCE TO RELATED APPLICATIONS

The present patent application is based on and claims priority pursuant to 35 U.S.C. §119 from Japanese Patent Application No. 2010-178346, filed on Aug. 9, 2010, in the Japan Patent Office, which is incorporated herein by reference in its entirety.

BACKGROUND OF THE INVENTION

1. Field of the Invention

Exemplary aspects of the present invention generally relate to a cleaning device including multiple cleaning members arranged side by side along a direction of movement of a cleaning target so as to remove adhered substances from a surface of the cleaning target. In addition, exemplary aspects of the present invention also generally relate to an image forming apparatus using the cleaning device to remove toner from a surface of an image carrier, and a method for mounting the cleaning device relative to the cleaning target.

2. Description of the Background

Related-art image forming apparatuses, such as copiers, printers, facsimile machines, and multifunction devices having two or more of copying, printing, and facsimile functions, typically form a toner image on a recording medium (e.g., a sheet of paper, etc.) according to image data using an electrophotographic method. In such a method, for example, a charger charges a surface of a photoconductor; an irradiating device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet of recording media; and a fixing device applies heat and pressure to the sheet bearing the toner image to fix the toner image onto the sheet. The sheet bearing the fixed toner image is then discharged from the image forming apparatus.

One example of a related-art image forming apparatus includes an intermediate transfer belt serving as an image carrier and a transfer roller contacting the intermediate transfer belt to form a transfer nip therebetween. The toner image, which in this arrangement is formed on the intermediate transfer belt, is transferred onto a sheet at the transfer nip. A slight amount of residual toner, which is not transferred onto the sheet at the transfer nip, remains on the intermediate transfer belt after passing through the transfer nip. Such residual toner is removed from the intermediate transfer belt using a cleaning device. The cleaning device generally includes two cleaning members, that is, an upstream cleaning brush roller rotatively contacting the intermediate transfer belt and a downstream cleaning brush roller rotatively contacting the intermediate transfer belt at a position downstream from the upstream cleaning brush roller in a direction of movement of the intermediate transfer belt so as to remove the residual toner from the intermediate transfer belt. Accordingly, even when the upstream cleaning brush roller cannot completely remove the residual toner from the intermediate transfer belt, the remaining toner can be reliably removed by the downstream cleaning brush roller. Thus, the cleaning device can reliably remove from the intermediate transfer belt not only the residual toner but also an untransferred toner image which remains untransferred from the intermediate transfer belt due to sheet jam and which has a larger amount of toner.

However, the above-described cleaning device increases maintenance costs due to the following reasons. The upstream cleaning brush roller handles a larger amount of toner than the downstream cleaning brush roller. Consequently, the upstream cleaning brush roller is generally exhausted faster than the downstream cleaning brush roller. Although the downstream cleaning brush roller is still usable when the upstream cleaning brush roller is used up, the cleaning device as a whole must be replaced with a new cleaning device in the related-art image forming apparatus, thereby increasing maintenance costs.

The above-described problem may also occur in a configuration that cleans a cleaning target other than the intermediate transfer belt.

SUMMARY

In view of the foregoing, illustrative embodiments of the present invention provide a novel cleaning device that can reduce maintenance costs, an image forming apparatus including the cleaning device, and a method for mounting the cleaning device.

In one illustrative embodiment, a cleaning device includes: multiple cleaning members arranged consecutively in a direction of movement of a cleaning target to remove adhered substances from the cleaning target; multiple casings to individually hold and at least partially enclose the multiple cleaning members, respectively, the casings and the cleaning members together constituting multiple sub-units; and a sub-unit holder to hold the multiple sub-units, from which the sub-units are individually removable.

Another illustrative embodiment provides an image forming apparatus including an image carrier to carry a toner image, an image forming unit to form the toner image on the image carrier, and the cleaning device described above to remove toner from the image carrier.

Yet another illustrative embodiment provides a method for mounting the cleaning device described above on the cleaning target. The method includes the steps of mounting multiple sub-units respectively including the multiple cleaning members and casings individually holding and at least partially enclosing the multiple cleaning members in a sub-unit holder, and mounting the cleaning device including the multiple sub-units thus mounted in the sub-unit holder on the cleaning target.

Additional features and advantages of the present disclosure will be more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
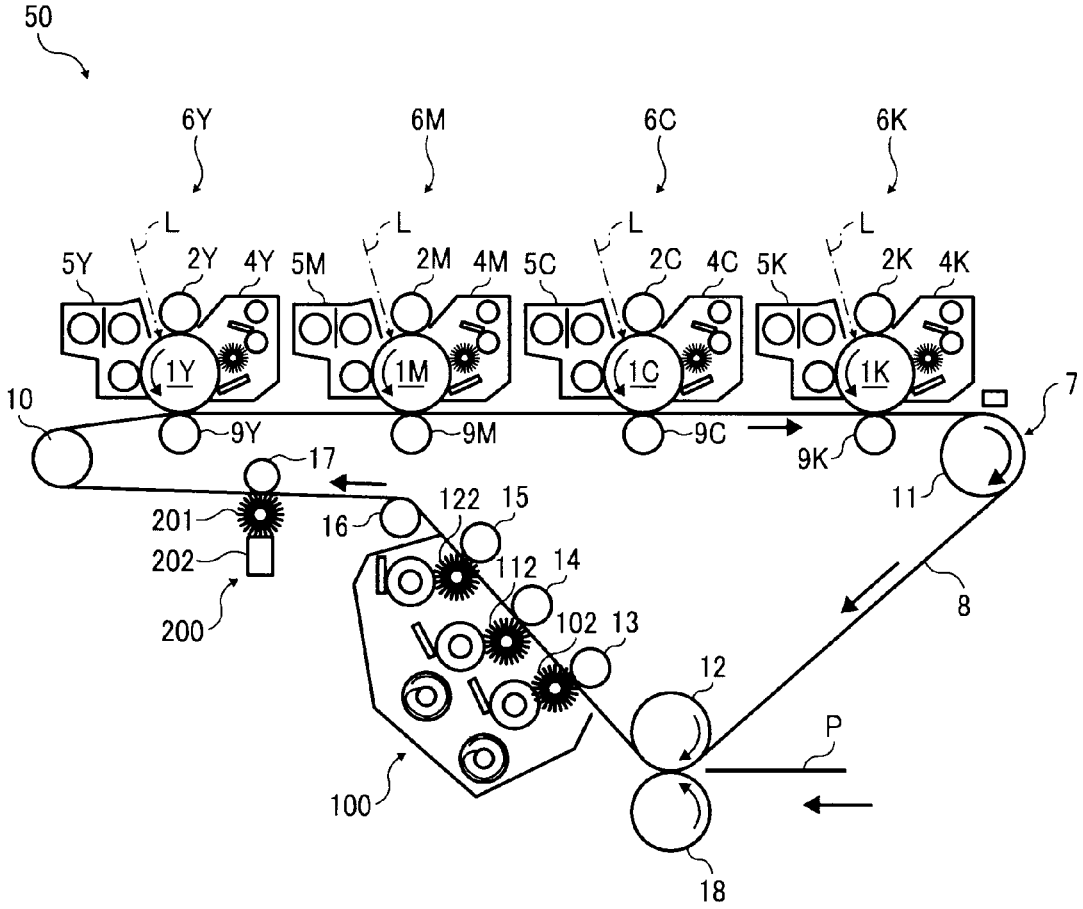
FIG. 1 is a vertical cross-sectional view illustrating an example of a configuration of a main part of an image forming apparatus according to illustrative embodiments.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings.

In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

A basic configuration and operation of a tandem-type image forming apparatus 50 employing an electrophotographic method according to the present illustrative embodiment are described in detail below.

FIG. 1 is a vertical cross-sectional view illustrating an example of a configuration of a main part of the image forming apparatus 50. The image forming apparatus 50 includes image forming units 6Y, 6M, 6C, and 6K (hereinafter collectively referred to as image forming units 6) that form a toner image of a specific color, that is, yellow (Y), magenta (M), cyan (C), or black (K). The image forming units 6 includes drum-shaped photoconductors 1Y, 1M, 1C, and 1K (hereinafter collectively referred to as photoconductors 1), respectively. Chargers 2Y, 2M, 2C, and 2K (hereinafter collectively referred to as chargers 2), developing devices 5Y, 5M, 5C, and 5K (hereinafter collectively referred to as developing devices 5), drum cleaning devices 4Y, 4M, 4C, and 4K (hereinafter collectively referred to as drum cleaning devices 4), and neutralizing devices, not shown, are provided around the photoconductors 1, respectively. Each of the four image forming units 6 has the same basic configuration, differing only in the color of toner used.

An optical unit, not shown, that directs laser light L onto surfaces of the photoconductors 1 to form electrostatic latent images on the surfaces of the photoconductors 1 is provided above the image forming units 6. A transfer unit 7 including an endless intermediate transfer belt 8 serving as an image carrier is provided below the image forming units 6.

The image forming apparatus 50 further includes multiple extension rollers provided inside a loop of the intermediate transfer belt 8 and components provided outside the loop of the intermediate transfer belt 8, such as a secondary transfer roller 18, a tension roller 16, a belt cleaning device 100, and a lubricant applicator 200.

The multiple extension rollers include four primary transfer rollers 9Y, 9M, 9C, and 9K (hereinafter collectively referred to as primary transfer rollers 9), a driven roller 10, a drive roller 11, a secondary transfer opposing roller 12, first, second, and third opposing roller 13, 14, 15, and an applicator opposing roller 17. The intermediate transfer belt 8 is wound around each of the above-described multiple extension rollers. It is to be noted that the first, second, and third opposing rollers 13, 14, and 15 apply a predetermined amount of tension to the intermediate transfer belt 8 but need not necessarily do so, and may be driven by rotation of the intermediate transfer belt 8.

The intermediate transfer belt 8 is rotated in a clockwise direction in FIG. 1 by rotation of the drive roller 11 rotatively driven in the clockwise direction by drive means, not shown.

The primary transfer rollers 9 are provided opposite the photoconductors 1 with the intermediate transfer belt 8 interposed therebetween. Accordingly, primary transfer nips are formed where the intermediate transfer belt 8 contacts each of the photoconductors 1. A primary transfer bias having a polarity opposite the polarity of toner is supplied from a power source, not shown, to each of the primary transfer rollers 9.

The secondary transfer opposing roller 12 is provided opposite the secondary transfer roller 18 with the intermediate transfer belt 8 interposed therebetween. Accordingly, a secondary transfer nip is formed at where the intermediate transfer belt 8 contacts the secondary transfer roller 18. It is to be noted that a secondary transfer bias having a polarity opposite the polarity of toner is supplied from a power source, not shown, to the secondary transfer roller 18. Accordingly, a secondary transfer magnetic field is formed at the secondary transfer nip so that a toner image formed on the intermediate transfer belt 8 is electrostatically transferred to a sheet P sandwiched between the intermediate transfer belt 8 and the secondary transfer roller 18 at the secondary transfer nip. Alternatively, a conveyance belt that conveys a sheet may be wound around the secondary transfer roller 18 and another roller. In such a case, the secondary transfer opposing roller 12 is provided opposite the secondary transfer roller 18 with both the intermediate transfer belt 8 and the conveyance belt interposed therebetween to form the secondary transfer nip.

The first, second, and third opposing rollers 13, 14, and 15, respectively, are provided opposite the belt cleaning device 100, respectively, with the intermediate transfer belt 8 interposed therebetween. Accordingly, cleaning nips are formed where the intermediate transfer belt 8 contacts each of first, second, and third cleaning brush rollers 102, 112, and 122 respectively included in the belt cleaning device 100. A configuration of the belt cleaning device 100 is described in detail later.

The image forming apparatus 50 further includes a sheet feeder, not shown. The sheet feeder includes a sheet feed cassette that stores the sheet P and a sheet feed roller that feeds the sheet P from the sheet feed cassette to a sheet feed path in the image forming apparatus 50. A pair of registration rollers, not shown, is provided upstream of the secondary transfer nip in FIG. 1 to temporarily stop conveyance of the sheet P fed from the sheet feeder so as to convey the sheet P to the secondary transfer nip at a predetermined timing. The sheet P is further conveyed from the secondary transfer nip to a fixing device, not shown, provided downstream of the secondary transfer nip in FIG. 1 to fix a toner image onto the sheet P. The image forming apparatus 50 may further include a toner supplier that supplies toner to the developing devices 5.

In addition to the plain paper that is widely used as the sheet P, special paper such as paper having an uneven surface and iron-on print paper used for thermal transfer is often used in recent years. Use of such special paper more often causes irregular secondary transfer of the toner image from the intermediate transfer belt 8 compared to use of the plain paper. Therefore, in the image forming apparatus 50, the intermediate transfer belt 8 is provided with a certain elasticity so as to be deformable at the secondary transfer nip in conformity with the toner image or the uneven surface of the sheet P. Specifically, the intermediate transfer belt 8 is constructed of at least a base layer, an elastic layer on the base layer, and a surface coating layer provided on the elastic layer. As a result, the intermediate transfer belt 8 can fully contact the uneven surface of the sheet P without an excessive transfer pressure at the secondary transfer nip, thereby preventing irregular transfer of the toner image. Thus, the toner image is evenly transferred onto the uneven surface of the sheet P, thereby providing a higher-quality image having even image density.

The lubricant applicator 200 supplies a lubricant to the intermediate transfer belt 8 to protect the surface of the intermediate transfer belt 8. The lubricant applicator 200 includes a solid lubricant 202 formed of zinc stearate and an application brush roller 201 serving as an application member. The application brush roller 201 rotatively contacts the solid lubricant 202 to supply lubricant powder scraped off from the lubricant 202 to the surface of the intermediate transfer belt 8.

Upon receipt of image data, the image forming apparatus 50 rotatively drives the drive roller 11 so as to rotate the intermediate transfer belt 8. The extension rollers other than the drive roller 11 are driven by the rotation of the intermediate transfer belt 8 itself, or alternatively, may be rotated in the clockwise direction in FIG. 1 at the same linear velocity as the drive roller 11. At the same time, the photoconductors 1 are rotatively driven. The chargers 2 evenly charge the surfaces of the photoconductors 1, and the laser light L is directed onto the charged surfaces of the photoconductors 1 to form electrostatic latent images on the surfaces of the photoconductors 1, respectively. The electrostatic latent images thus formed on the surfaces of the photoconductors 1 are developed by the developing devices 5 so that toner images of the respective colors are formed on the surfaces of the photoconductors 1. The toner images of the respective colors are primarily transferred onto the intermediate transfer belt 8 at the primary transfer nips, respectively, and sequentially superimposed one atop the other to form a full-color toner image on the intermediate transfer belt 8.

Meanwhile, in the sheet feeder, not shown, the sheet P is fed one by one from the sheet feed cassette by the sheet feed roller to be conveyed to the pair of registration rollers. The pair of registration rollers is driven such that the sheet P is conveyed to the secondary transfer nip in synchronization with the full-color toner image formed on the intermediate transfer belt 8. Accordingly, the full-color toner image is secondarily transferred from the intermediate transfer belt 8 onto the sheet P. Thus, the full-color toner image is formed on the sheet P. The sheet P bearing the full-color toner image thereon is then conveyed from the secondary transfer nip to the fixing device to fix the full-color toner image onto the sheet P.

The drum cleaning devices 4 remove residual toner from the surfaces of the photoconductors 1, respectively, after primary transfer of the toner images from the surfaces of the photoconductors 1 onto the intermediate transfer belt 8. Thereafter, the neutralizing devices neutralize the surfaces of the photoconductors 1, and then the chargers 2 evenly charge the surfaces of the photoconductors 1 to be ready for the next sequence of image formation. The belt cleaning device 100 removes residual toner from the intermediate transfer belt 8 after secondary transfer of the full-color toner image from the intermediate transfer belt 8 onto the sheet P.

Figure 2:
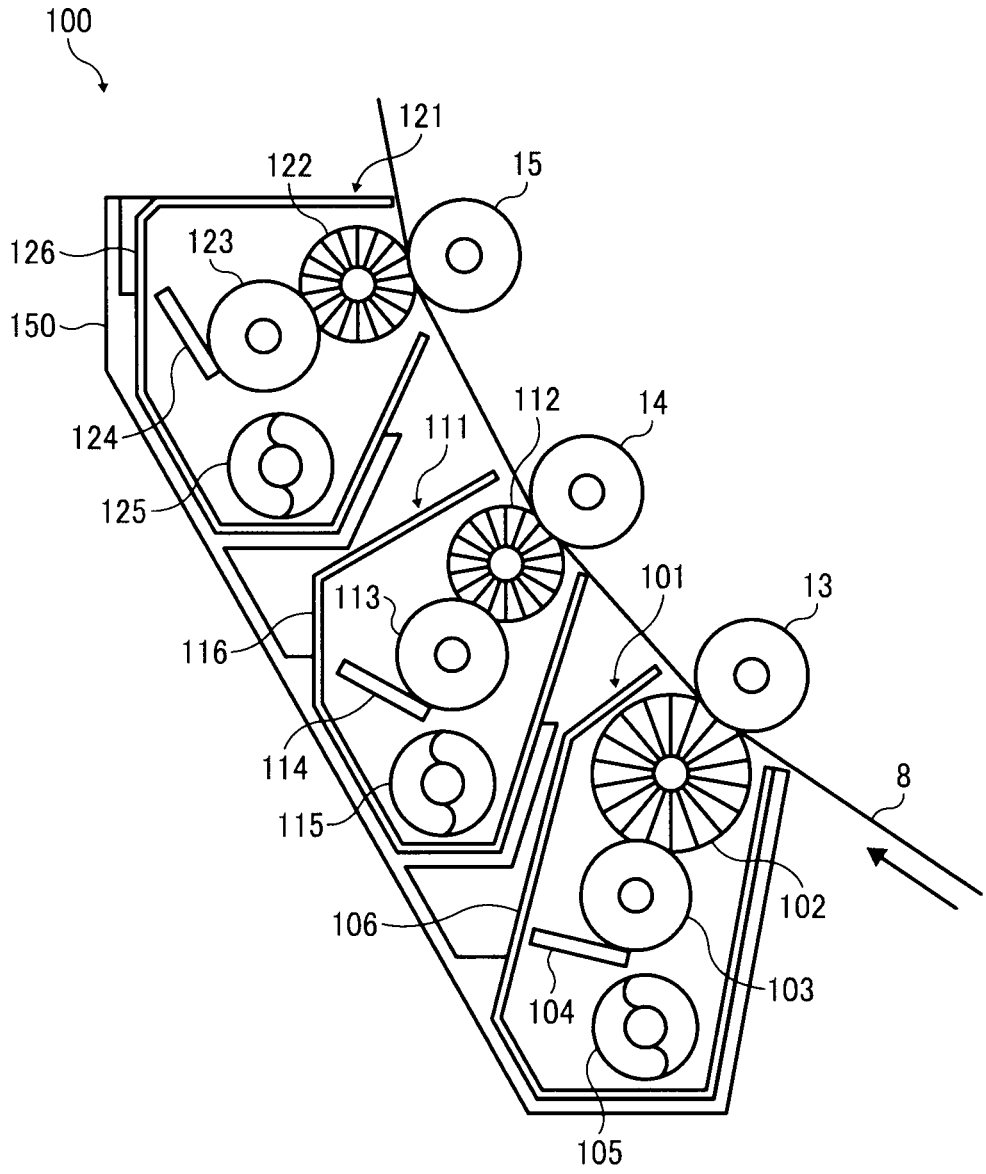
FIG. 2 is a schematic view illustrating an example of a configuration of a belt cleaning device and surrounding components according to illustrative embodiments.

FIG. 2 is a schematic view illustrating an example of a configuration of the belt cleaning device 100 and surrounding components. The belt cleaning device 100 includes three cleaning members, that is, the first cleaning brush roller 102, the second cleaning brush roller 112 provided downstream from the first cleaning brush roller 102 in a direction of rotation of the intermediate transfer belt 8, and the third cleaning brush roller 122 provided downstream from the second cleaning brush roller 112.

The first cleaning brush roller 102 removes from the intermediate transfer belt 8 residual toner or much of the toner in an untransferred toner image remaining untransferred from the intermediate transfer belt 8 due to sheet jam. The first cleaning brush rollers 102 is constructed of a metal rotary shaft and a brush part formed of multiple conductive fibers provided to the circumference of the metal rotary shaft, and contacts the intermediate transfer belt 8 downstream from the secondary transfer nip to form a first cleaning nip. A first cleaning bias having a positive polarity, which is opposite a normal charging polarity of the toner, that is, a negative polarity, is applied to the rotary shaft of the first cleaning brush roller 102 by a power source, not shown. Much of the toner on the intermediate transfer belt 8 after passing through the secondary transfer nip is collected to the first cleaning brush roller 102 by an electrostatic force generated by the first cleaning bias and by mechanical scraping of the first cleaning brush roller 102 against the intermediate transfer belt 8. However, a slight amount of toner may remain on the intermediate transfer belt 8 without being removed therefrom by the first cleaning brush roller 102. A first collection roller 103 contacts the first cleaning brush roller 102 on a side of the first cleaning brush roller 102 opposite the intermediate transfer belt 8 to form a first collection nip therebetween. A first collection bias greater than the first cleaning bias and having a positive polarity is applied to the first collection roller 103. Thus, the toner collected by the first cleaning brush roller 102 is moved to the first collection roller 103 by an electrostatic force generated by the first collection bias. Then, the toner thus attached to the first collection roller 103 is scraped off from the first collection roller 103 by a first scraper 104 contacting the first collection roller 103 on a side away from the first cleaning brush roller 102. It is to be noted that a first scraping bias greater than the first collection bias and having the positive polarity may be applied to the first scraper 104. The toner thus scraped off by the first scraper 104 is discharged from the belt cleaning device 100 by a first screw 105. In a case in which a solid image formed on the intermediate transfer belt 8 is not secondarily transferred onto the sheet P due to sheet jam and is conveyed to the first cleaning nip, about 90% of the solid image is removed by the first cleaning brush roller 102 by appropriately setting the first cleaning bias, a width of the first cleaning nip, and so forth.

Of the toner which is not removed from the intermediate transfer belt 8 by the first cleaning brush roller 102, the second cleaning brush roller 112 removes reversely-charged toner (e.g., positively-charged toner) having a polarity opposite the normal charging polarity of toner. Like the first cleaning brush roller 102, the second cleaning brush roller 112 is constructed of a metal rotary shaft and a brush part formed of multiple conductive fibers provided to the circumference of the metal rotary shaft, and contacts the intermediate transfer belt 8 downstream from the first cleaning nip to form a second cleaning nip. A second cleaning bias having a negative polarity, which is the same as the normal charging polarity of toner, is applied to the rotary shaft of the second cleaning brush roller 112 by a power source, not shown. The positively-charged toner on the intermediate transfer belt 8 is collected to the second cleaning brush roller 112 by an electrostatic force generated by the second cleaning bias and by mechanical scraping of the second cleaning brush roller 112. A second collection roller 113 contacts the second cleaning brush roller 112 to form a second collection nip therebetween. A second collection bias having a negative polarity and greater than the second cleaning bias is applied to the second collection roller 113. Thus, the positively-charged toner collected by the second cleaning brush roller 112 is moved to the second collection roller 113 by an electrostatic force generated by the second collection bias. Then, the positively-charged toner thus attached to the second collection roller 113 is scraped off from the second collection roller 113 by a second scraper 114 contacting the second collection roller 113. It is to be noted that a second scraping bias having a negative polarity and greater than the second collection bias may be applied to the second scraper 114. The toner thus scraped off is discharged from the belt cleaning device 100 by a second screw 115.

Of the toner which is not removed by the first cleaning brush roller 102, the third cleaning brush roller 122 removes normally-charged toner (e.g., negatively-charged toner). Like the first and second cleaning brush rollers 102 and 112, the third cleaning brush rollers 122 is constructed of a metal rotary shaft and a brush part formed of multiple conductive fibers provided to the circumference of the metal rotary shaft, and contacts the intermediate transfer belt 8 at a portion downstream from the second cleaning nip to form a third cleaning nip. A third cleaning bias having a positive polarity is applied to the rotary shaft of the third cleaning brush roller 122 by a power source, not shown. The negatively-charged toner on the intermediate transfer belt 8 is collected to the third cleaning brush roller 122 by an electrostatic force generated by the third cleaning bias and by mechanical scraping of the third cleaning brush roller 122. A third collection roller 123 contacts the third cleaning brush roller 122 to form a third collection nip therebetween. A third collection bias having the positive polarity and greater than the third cleaning bias is applied to the third collection roller 123. Thus, the negatively-charged toner collected by the third cleaning brush roller 122 is moved to the third collection roller 123 by an electrostatic force generated by the third collection bias. Then, the negatively-charged toner thus attached to the third collection roller 123 is scraped off from the third collection roller 123 by a third scraper 124 contacting the third collection roller 123. It is to be noted that a third scraping bias having the positive polarity and greater than the third collection bias may be applied to the third scraper 124. The toner thus scraped off is discharged from the belt cleaning device 100 by a third screw 125.

In the present embodiment, each of the first, second, and third cleaning brush rollers 102, 112, and 122 has a diameter of from 15 mm to 30 mm. Each of the multiple fibers forming the brush parts of the first, second, and third cleaning brush rollers 102, 112, and 122 has a core-in-sheath type structure, in which a conductive material such as conductive carbon is dispersed in an insulating material such as polyester provided in a surface layer of the fibers. Accordingly, a core of each of the fibers has an electric potential substantially the same as the voltage applied to each of the cleaning brush rollers 102, 112, and 122, thereby electrostatically attracting the toner to the surface of the fiber. Thus, the toner on the intermediate transfer belt 8 is electrostatically attached to the fibers by the voltage applied to each of the cleaning brush rollers 102, 112, and 122.

It is to be noted that, in place of the conductive fibers having a core-in-sheath type structure, the fibers of the cleaning brush rollers 102, 112, and 122 are formed of a conductive material only. In addition, the fibers may be transplanted to the rotary shaft of each of the cleaning brush rollers 102, 112, and 122 at an angle thereto, in a direction of a normal line of the rotary shaft. Further alternatively, the fibers of the first and third cleaning brush roller 102 and 122 may have a core-in-sheath type structure while the fibers of the second cleaning brush roller 112 may be formed of conductive fibers only. As a result, the fibers of the second cleaning brush roller 112 formed only of the conductive material can easily inject negative electrical charges into the toner at the second cleaning nip. Meanwhile, the core-in-sheath type structure of the fibers in the first and third cleaning brush rollers 102 and 122 can suppress charge injection into the toner at the first and third cleaning nips, thereby preventing the toner on the intermediate transfer belt 8 from being positively charged.

Each of the cleaning brush rollers 102, 112, and 122 contacts the intermediate transfer belt 8 with an engagement of 1 mm. The amount of engagement is a value obtained by subtracting a distance between the center of each of the collection rollers 103, 113, and 123 and the center of each of the cleaning brush rollers 102, 112, and 122 from a sum of a radius of each of the collection rollers 103, 113, and 123, a radius of each of the cleaning brush rollers 102, 112, and 122, and a thickness of the intermediate transfer belt 8. Each of the cleaning brush rollers 102, 112, and 122 is rotated such that the fibers of each of the cleaning brush rollers 102, 112, and 123 are moved against the direction of rotation of the intermediate transfer belt 8 at each of the cleaning nips. Accordingly, a difference in linear velocity between the intermediate transfer belt 8 and each of the cleaning brush rollers 102, 112, and 122 can be increased at the cleaning nips, thereby more fully collecting the toner from the intermediate transfer belt 8.

In the present embodiment, a stainless-steel roller in which a shaft member and a roller member are integrally formed of stainless steel is used for each of the collection rollers 103, 113, and 123. It is to be noted that any material may be used for the collection rollers 103, 113, and 123 as long as the toner attached to the cleaning brush rollers 102, 112, and 122 is translocated to the collection rollers 103, 113, and 123, respectively, using the electric potential difference between the collection rollers 103, 113, and 123 and the conductive fibers of the cleaning brush rollers 102, 112, and 122. For example, a conductive metal core of each of the collection rollers 103, 113, and 123 may be coated with a high-resistance elastic tube having a thickness of from several μm to 100 μm and be further coated with an insulating material, such that each of the collection rollers 103, 113, and 123 has a roller resistance logR of from 12Ω to 13Ω. Use of the stainless-steel roller for each of the collection rollers 103, 113, and 123 can reduce production costs, applied voltages, and running costs. Further, setting the roller resistance logR to the above-described range of 12Ω and 13Ω suppresses charge injection into the toner upon collection of the toner to the collection rollers 103, 113, and 123, thereby preventing a decrease in collection efficiency.

Each of the cleaning brush rollers 102, 112, and 122 is set as follows. As described above, the fibers of each of the cleaning brush rollers 102, 112, and 122 are formed of conductive polyester and have a core-in-sheath type structure. Each of the cleaning brush rollers 102, 112, and 122 has a resistivity of from $10^6\Omega$ to $10^8\Omega$ and a density of 100,000 fibers per square inch. Each of the brush fibers has a diameter of from about 25 μm to 35 μm, and a leading edge of each of the brush fiber is bent. The first cleaning brush roller 102 has a diameter of from ϕ15 mm to ϕ30 mm, and each of the second and third cleaning brush rollers 112 and 122 has a diameter of from ϕ15 mm to ϕ16 mm. The first, second, and third cleaning brush rollers 102, 112, and 122 contact the intermediate transfer belt 8 with an engagement of 1 mm. The first cleaning bias of from +1,600 V to +2,000 V is applied to the rotary shaft of the first cleaning brush roller 102. The second cleaning bias of from −2,000 V to −2,400 V is applied to the rotary shaft of the second cleaning brush roller 112. The third cleaning bias of from +800 V to +1,200 V is applied to the rotary shaft of the third cleaning brush roller 122. The second cleaning bias is set slightly higher so as to inject negative electrical charges into the positively-charged toner on the intermediate transfer belt 8 at the second cleaning nip.

The configuration of the cleaning brush rollers 102, 112, and 122 is not limited to the above-described example, and may be varied as appropriate depending on the system. Examples of materials for use in the conductive fibers are, but are not limited to, nylon, acrylic, and polyester.

As described above, the metal core of each of the collection rollers 103, 113, and 123 is formed of stainless steel. The fibers of each of the cleaning brush rollers 102, 112, and 122 contact the collection rollers 103, 113, and 123 with an engagement of 1.5 mm, respectively. The first collection bias of from +2,000 V to +2,400 V is applied to the metal core of the first collection roller 103. The second collection bias of from −2,400 to −2,800 is applied to the metal core of the second collection roller 113. The third collection bias of from +1,000 to +1,400 is applied to the metal core of the third collection roller 123. As with the cleaning brush rollers, the configuration of the scrapers 104, 114, and 124 is not limited to the above-described example, and may be varied as appropriate depending on the system.

Each of the first, second, and third scrapers 104, 114, and 124 has a thickness of 0.1 mm and contacts the surfaces of the collection rollers 103, 113, and 123 with an engagement of 1.0 mm, respectively, so as to face in the rotation direction of the collection rollers 103, 113, and 123 at a contact angle of 20°.

It is to be noted that the configuration of the scrapers 104, 114, and 124 is not limited to the above-described example, and may be varied as appropriate depending on the system.

As described above, the first cleaning brush roller 102 is provided to remove much of the toner from the intermediate transfer belt 8, so that even a larger amount of toner remaining on the intermediate transfer belt 8 due to sheet jam or the like can be reliably removed from the intermediate transfer belt 8. Specifically, the positively-charged toner or the negatively-charged toner that cannot be removed by the first cleaning brush roller 102 can be optimally removed from the intermediate transfer belt 8 by the second and third cleaning brush rollers 112 and 112, both provided downstream from the first cleaning brush roller 102.

A description is now given of main features of the image forming apparatus 50.

Figure 3:
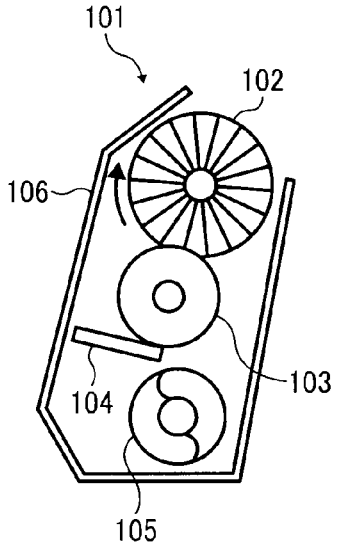
FIG. 3 is a schematic view illustrating an example of a configuration of a first sub-unit included in the belt cleaning device illustrated in FIG. 2.
Figure 4:
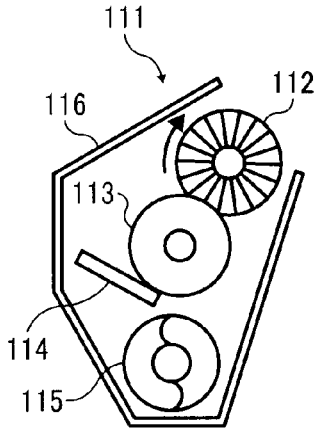
FIG. 4 is a schematic view illustrating an example of a configuration of a second sub-unit included in the belt cleaning device illustrated in FIG. 2.
Figure 5:
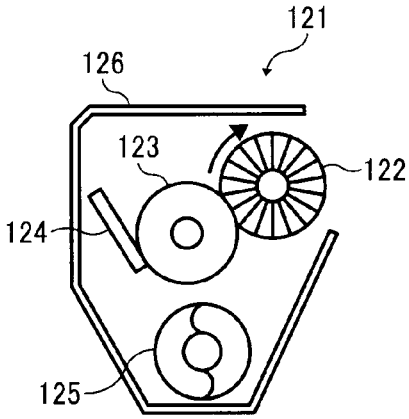
FIG. 5 is a schematic view illustrating an example of a configuration of a third sub-unit included in the belt cleaning device illustrated in FIG. 2.

The first cleaning brush roller 102, the first collection roller 103, the first scraper 104, and the first screw 105 are held within a first casing 106, and constitute a first sub-unit 101. FIG. 3 is a schematic view illustrating an example of a configuration of the first sub-unit 101. The first sub-unit 101 is removably installable in a sub-unit holder 150 of the belt cleaning device 100. Similarly, the second cleaning brush roller 112, the second collection roller 113, the second scraper 114, and the second screw 115 are held within a second casing 116 constituting a second sub-unit 111. FIG. 4 is a schematic view illustrating an example of a configuration of the second sub-unit 111. The second sub-unit 111 is also removably installable in the sub-unit holder 150. Similarly, the third cleaning brush roller 122, the third collection roller 123, the third scraper 124, and the third screw 125 are held within a third casing 126 and constitute a third sub-unit 121. FIG. 5 is a schematic view illustrating an example of a configuration of the third sub-unit 121. The third sub-unit 121 is also removably installable in the sub-unit holder 150.

Figure 6:
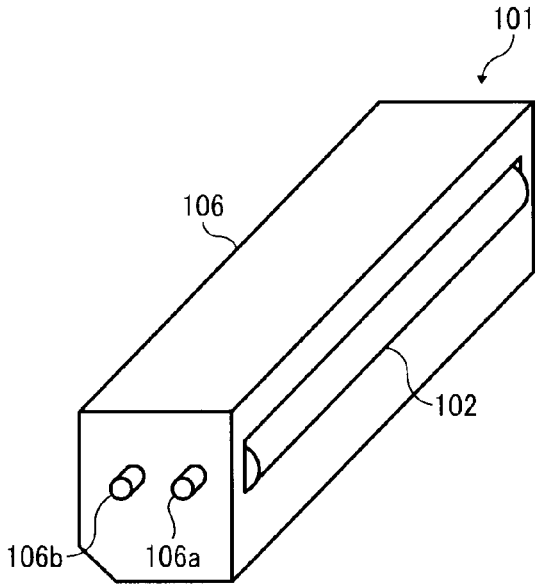
FIG. 6 is a perspective view illustrating the configuration of the first sub-unit viewed from one end thereof in a longitudinal direction.

FIG. 6 is a perspective view illustrating the configuration of the first sub-unit 101 viewed from one end thereof in a longitudinal direction, that is, an axial direction. The first casing 106 of the first sub-unit 101 serves as a holder and has first and second positioning protrusions 106a and 106b, each protruding outward from both lateral end surfaces of the first casing 106 in the axial direction. Thus, although not shown in FIG. 6, the first and second positioning protrusions 106a and 106b are also provided to the lateral surface at the other end of the first casing 106 in a similar manner as described above. In addition, although not shown, the first and second positioning protrusions 106*a* and 106*b* are provided also to both lateral surfaces of each of the second and third casings 116 and 126, each serving as a holder, in a similar manner as the first sub-unit 101.

Figure 7:
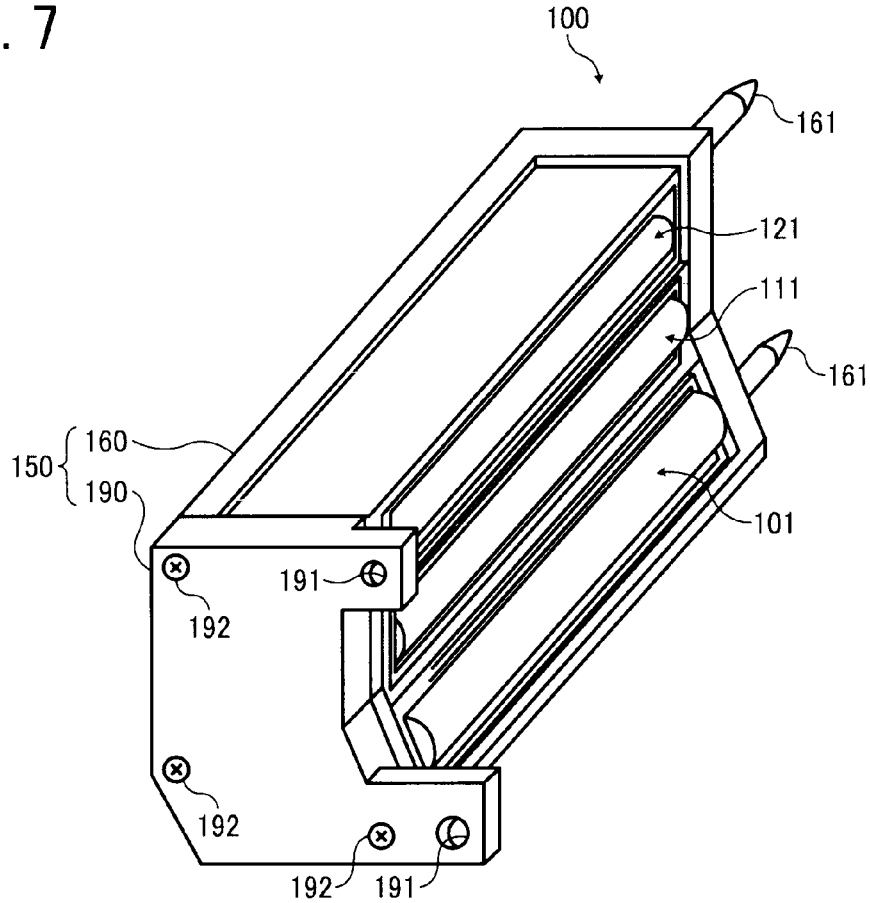
FIG. 7 is a perspective view illustrating the configuration of the belt cleaning device viewed from one end thereof in a longitudinal direction.

FIG. 7 is a perspective view illustrating the configuration of the belt cleaning device 100 viewed from one end thereof in a longitudinal direction. In the belt cleaning device 100, the sub-unit holder 150 that holds the first, second, and third sub-units 101, 111, and 121 is constructed of an L-shaped main frame 160 and a separate side plate 190 attached to the main frame 160 as main components thereof. The side plate 190 forms a lateral wall of the sub-unit holder 150 at one end thereof and is fixed to the main frame 160 with screws 192. The main frame 160 forms a lateral wall of the sub-unit holder 150 at the other end thereof, a back wall of the sub-unit holder 150, and so forth.

Figure 8:
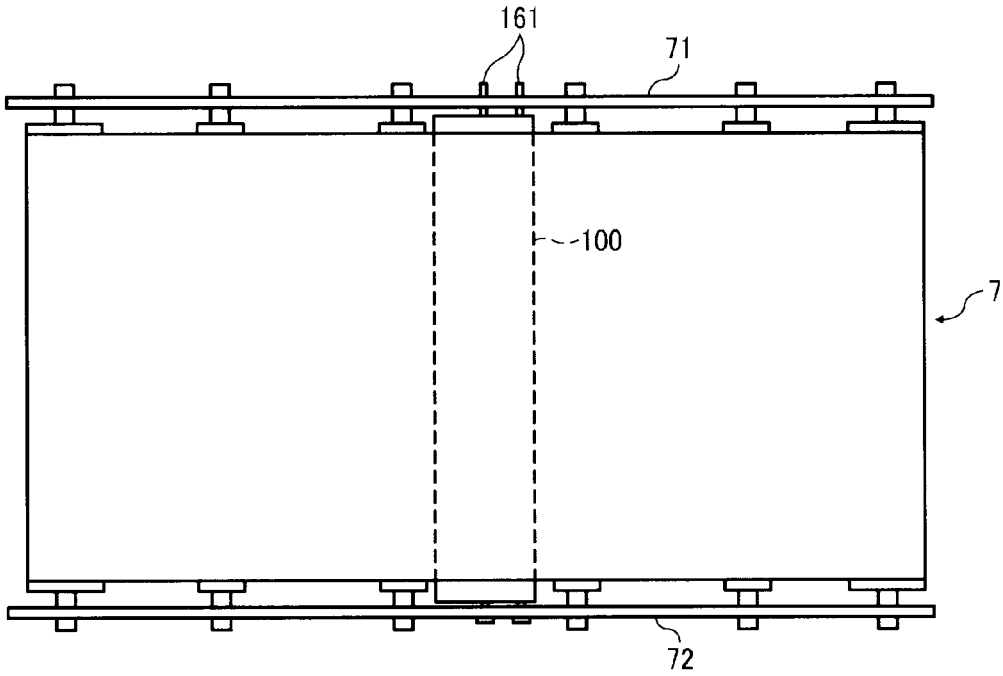
FIG. 8 is a top view illustrating relative positions of a transfer unit and the belt cleaning device.

Two positioning pins 161 protrude outward from the lateral wall of the main frame 160. As illustrated in FIG. 8, the positioning pins 161 are inserted into positioning holes provided to a front plate 71 of the transfer unit 7 so as to position the belt cleaning device 100 in the transfer unit 7.

Figure 9:
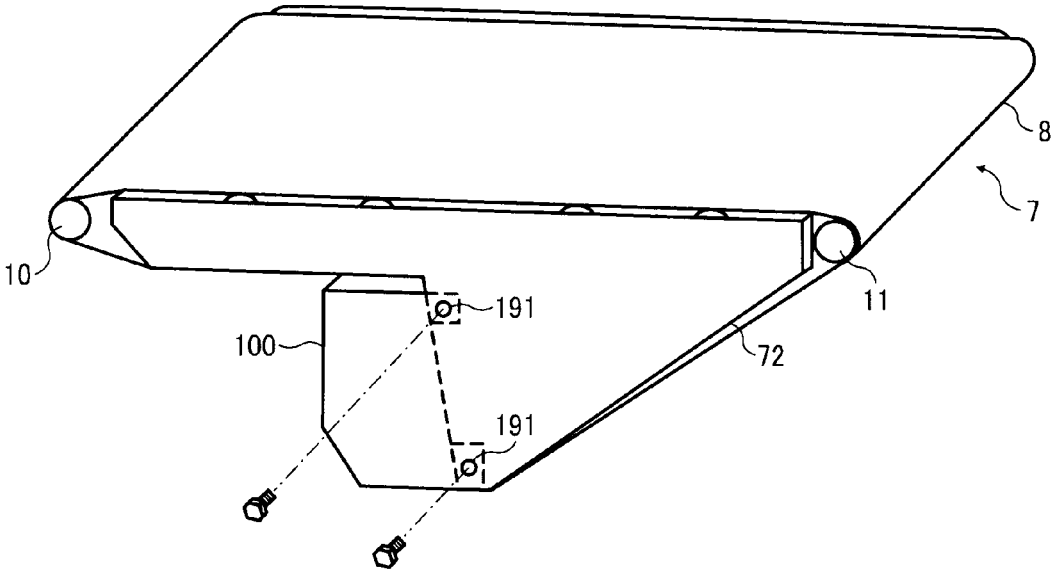
FIG. 9 is a perspective view illustrating the relative positions of the transfer unit and the belt cleaning device.

Returning to FIG. 7, two positioning holes 191 are provided to the side plate 190. As illustrated in FIG. 9, bolts inserted into the positioning holes 191 are fastened to a back plate 72 of the transfer unit 7 so as to position the belt cleaning device 100 in the transfer unit 7.

Figure 10:
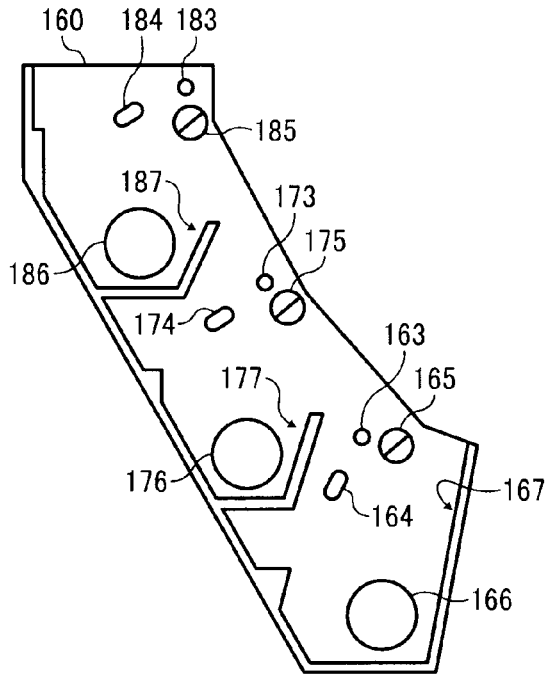
FIG. 10 is a side view illustrating a configuration of a main frame of a sub-unit holder viewed from one end in a longitudinal direction thereof.

FIG. 10 is a side view illustrating a configuration of the main frame 160 of the sub-unit holder 150 viewed from one end in a longitudinal direction thereof. Front and bottom walls of the main frame 160 form a first compartment 167 that holds the first sub-unit 101. A first main positioning concavity 163, a first sub-positioning concavity 164, a first coupling 165, and a first toner discharge opening 166 are provided to the lateral wall of the main frame 160. The first main positioning concavity 163 engages the first positioning protrusion 106*a* provided to the first casing 106 of the first sub-unit 101 so as to position the first sub-unit 101 relative to the main frame 160. The first sub-positioning concavity 164 engages the second positioning protrusion 106*b* provided to the first casing 106 of the first sub-unit 101 so as to position the first sub-unit 101 relative to the main frame 160. The first main positioning concavity 163 has a circular shape, while the first sub-positioning concavity 164 is oval. The oval first sub-positioning concavity 164 engages the second positioning protrusion 106*b* so as to compensate for slight positional errors between the first and second positioning protrusions 106*a* and 106*b* in the first casing 106. The first coupling 165 is rotatably provided to the lateral wall of the main frame 160. The first coupling 165 is integrally formed together with an external coupling, not shown, provided outside the lateral wall of the main frame 160 so as to pass through the lateral wall and be rotatably supported by the lateral wall. When the first sub-unit 101 is set to the main frame 160, a drive coupling provided to the first sub-unit 101 engages the first coupling 165. In such a state, when the belt cleaning device 100 is installed in the image forming apparatus 50, a motor coupling provided to the image forming apparatus 50 engages the external coupling provided to the main frame 160. As a result, a drive force is transmitted from the motor coupling to rotary members of the first sub-unit 101 through the external coupling and the first coupling 165. The first toner discharge opening 166 discharges toner discharged from the first sub-unit 101 by the first screw 105 outside the main frame 160.

In addition, a second main positioning concavity 173, a second sub-positioning concavity 174, a second coupling 175, and a second toner discharge opening 176, and a second compartment 177 are provided to the lateral wall of the main frame 160. The second main positioning concavity 173 engages the first positioning protrusion provided to the second casing 116 of the second sub-unit 111 so as to position the second sub-unit 111 relative to the main frame 160. The second sub-positioning concavity 174 engages the second positioning protrusion provided to the second casing 116 of the second sub-unit 111 so as to position the second sub-unit 111 relative to the main frame 160. In a similar manner to the first sub-unit 101, the second main positioning concavity 173 is circular while the second sub-positioning concavity 174 is oval. The function of the second coupling 175 is the same as that of the first coupling 165. In addition, the function of the second toner discharge opening 176 is the same as that of the first toner discharge opening 166 of the first sub-unit 101.

A third main positioning concavity 183, a third sub-positioning concavity 184, a third coupling 185, a third toner discharge opening 186, and a third compartment 187 are provided to the lateral wall of the main frame 160. The third main positioning concavity 183 engages the first positioning protrusion provided to the third casing 126 of the third sub-unit 121 so as to position the third sub-unit 121 relative to the main frame 160. The third sub-positioning concavity 184 engages the second positioning protrusion provided to the third casing 126 of the third sub-unit 121 so as to position the third sub-unit 121 relative to the main frame 160. In a similar manner to the first sub-unit 101, the third main positioning concavity 183 is a circle while the third sub-positioning concavity 184 is an oval. The function of the third coupling 185 is the same as that of the first coupling 165. In addition, the function of the third toner discharge opening 186 is the same as that of the first toner discharge opening 166 of the first sub-unit 101.

Figure 11:
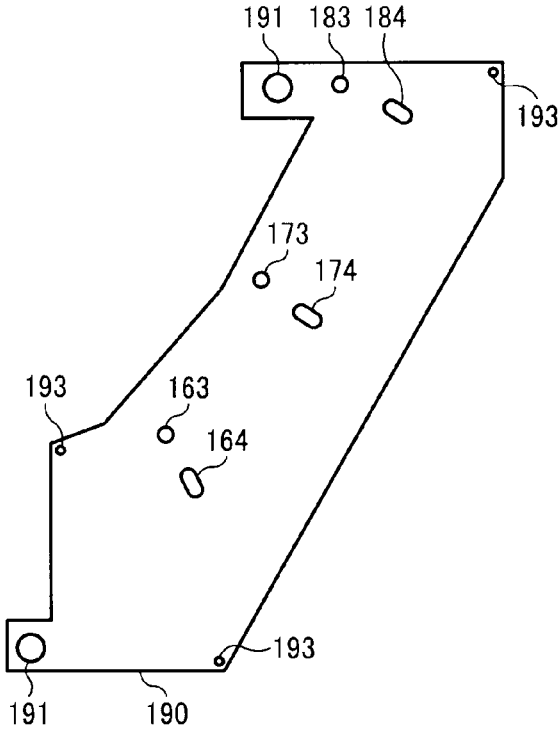
FIG. 11 is a side view illustrating a configuration of a side plate of the sub-unit holder viewed from inside the sub-unit holder.

FIG. 11 is a side view illustrating a configuration of the side plate 190 of the sub-unit holder 150 viewed from inside the sub-unit holder 150. In a manner similar to the main frame 160, the first main positioning concavity 163, the first sub-positioning concavity 164, the second main positioning concavity 173, the second sub-positioning concavity 174, the third main positioning concavity 183, and the third sub-positioning concavity 184 are provided to an inner surface of the side plate 190. In addition, screw holes 193 into which the screws 192 are inserted and the positioning holes 191 are provided to the side plate 190.

As described above, the sub-unit holder 150, in which the first, second, and third sub-units 101, 111, and 121 are removably installed, positions the sub-units 101, 111, and 121 relative to one another while holding the sub-units 101, 111, and 121 in place. Even when the sub-unit holder 150 is disassembled into the main frame 160 and the side plate 190, the components remain stored within each of the sub-units 101, 111, and 121 without being displaced or destroyed. Thus, each of the cleaning brush rollers 102, 112, and 122 is formed as a part of each of the sub-units 101, 111, and 121, and is removably installable in the sub-unit holder 150 together with the sub-units 101, 111, and 121. As a result, each of the cleaning brush rollers 102, 112, and 122 is individually replaceable separately from one another. In a case in which one of the three cleaning brush rollers 102, 112, and 122 is exhausted, only one of the sub-units 101, 111, and 121 that includes the corresponding cleaning brush roller 102, 112, or 122 is replaced with a new sub-unit. Accordingly, the rest of the cleaning brush rollers 102, 112, and 122 and the surrounding components within the rest of the sub-units 101, 111, and 121 can be used thereafter, thereby reducing maintenance costs.

Although the components therein are completely enclosed within the casings 106, 116, or 126 in the above-described embodiment, alternatively, only a part of them may be enclosed within the casing 106, 116, or 126 as long as the components therein cannot be easily removed therefrom and are kept in predetermined orientations therein. For example, a holder constructed of a first lateral plate that supports components such as the cleaning brush roller at one end in the axial direction and a second plate that supports the components at the other end is also feasible unless the first and second lateral plates are axially displaced.

As illustrated in FIG. 2, the first cleaning brush roller 102 that handles the largest amount of toner among the three cleaning brush roller 102, 112, and 122 has a larger diameter than the second and third cleaning brush rollers 112 and 122. Accordingly, the first cleaning brush roller 102 is rotated at the same linear velocity with fewer rotations compared to the other two cleaning brush rollers 112 and 122, thereby slowing deterioration of the first cleaning brush roller 102. As a result, the product life of the first cleaning brush roller 102 is extended closer to the product life of each of the second and third cleaning brush rollers 112 and 122, thereby preventing more frequent replacement of the first cleaning brush roller 102 than the second and third cleaning brush rollers 112 and 122.

In a manner similar to the first cleaning brush roller 102, the first collection roller 103 may have a larger diameter than the other two collection rollers 113 and 123. Accordingly, the product life of the first collection roller 103 is also extended closer to the product life of each of the second and third collection rollers 113 and 123.

Although in the above-described example, negative electrical charges are injected into the positively-charged toner, alternatively the second cleaning brush roller 112 may merely remove the positively-charged toner from the intermediate transfer belt 8 without charge injection.

In addition, relative positions of the second and third cleaning brush rollers 112 and 122 may be reversed. In such a case, the third cleaning brush roller 122 provided upstream from the second cleaning brush roller 112 may inject positive electrical charges into a part of the toner to positively charge the part of the toner. As a result, the second cleaning brush roller 112 provided downstream from the third cleaning brush roller 122 can remove the positively-charged toner from the intermediate transfer belt 8.

Further alternatively, the second cleaning brush roller 112 may function only as a charge injection roller that injects negative electrical charges into the positively-charged toner so as not to remove the positively-charged toner from the intermediate transfer belt 8. As a result, the third cleaning brush roller 122 provided downstream from the second cleaning brush roller 112 can remove the toner thus negatively charged from the intermediate transfer belt 8. It is to be noted that a blade or a corona charger may be used in place of the cleaning brush roller to inject negative electrical charges into the toner.

In place of application of the cleaning bias to the rotary shaft of each of the cleaning brush rollers 102, 112, and 122, the cleaning bias may be applied to each of the cleaning brush rollers 102, 112, and 122 through each of the collection rollers 103, 113, and 123 formed of metal. In such a case, a voltage slightly smaller than the voltage applied to the collection rollers 103, 113, and 123 is applied to each of the cleaning brush rollers 102, 112, and 122 through the collection nips due to an electric potential decrease caused by resistance of the fibers in the cleaning brush rollers 102, 112, and 122. Accordingly, an electric potential difference is formed between the collection rollers 103, 113, and 123 and the cleaning brush rollers 102, 112, and 122, respectively. As a result, the toner is electrostatically moved from the cleaning brush rollers 102, 112, and 122 to the collection rollers 103, 113, and 123 using an electric potential gradient to the collection rollers 103, 113, and 123.

The belt cleaning device 100 according to the present illustrative embodiment is also applicable to a cleaning device that cleans an image carrier other than the intermediate transfer belt 8. For example, the belt cleaning device 100 may be employed as the drum cleaning device 4 that clean the photoconductors 1 each also serving as an image carrier.

The number of sub-units provided within the belt cleaning device 100 is not limited to three, and alternatively, may be two or four.

It is to be noted that the front plate 71 serves as a coupling member that couples the sub-unit holder 150 and the intermediate transfer belt 8. Accordingly, even when the side plate 190 is removed from the sub-unit holder 150, the main frame 160 remain engaged with the front plate 71 so that the sub-units 101, 111, and 121 can be individually installed in or removed from the main frame 160 while the main frame 160 is coupled to the intermediate transfer belt 8. Thus, replacement of the sub-units 101, 111, and 121 is facilitated.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims.

The number of constituent elements and their locations, shapes, and so forth are not limited to any of the structure for performing the methodology illustrated in the drawings.

What is claimed is:

1. A cleaning device, comprising:

at least two cleaning brush rollers arranged consecutively in a direction of movement of a cleaning target to remove adhered substances from the cleaning target;

at least two casings to individually hold and at least partially enclose a corresponding one of the at least two cleaning brush rollers, wherein multiple sub-units include the casings and the cleaning brush rollers; and a sub-unit holder to hold the multiple sub-units, from which the sub-units are individually removable and into which a new sub-unit is installable, after a corresponding one of the multiple sub-units is removed.

2. The cleaning device according to claim 1, further comprising a coupling member to couple the sub-unit holder and the cleaning target, wherein the multiple sub-units are individually installable in and removable from the sub-unit holder in an installed state in which the sub-unit holder remains coupled to the cleaning target by the coupling member.

3. The cleaning device according to claim 1, wherein:

the cleaning brush rollers are of unequal size, and an extreme upstream cleaning brush roller among the at least two cleaning brush rollers, provided at an extreme upstream side in the direction of movement of the cleaning target, being larger than the remaining cleaning brush rollers.

4. The cleaning device according to claim 1, further comprising:

another cleaning member arranged in the direction of movement of the cleaning target to remove the adhered substances from the cleaning target; and a third casing to individually hold and at least partially enclose the another cleaning member, the third casing and the another cleaning member together constituting a third sub-unit, wherein the sub-unit holder hold the multiple sub-units including the third subunit which is individually removable.

5. The cleaning device according to claim 4, wherein:

the another cleaning member is a cleaning brush roller.

6. An image forming apparatus, comprising:

an image carrier to carry a toner image;

an image forming unit to form the toner image on the image carrier; and a cleaning device to remove toner from the image carrier, the cleaning device comprising:

at least two cleaning brush rollers arranged consecutively in a direction of movement of a cleaning target to remove adhered substances from the cleaning target;

at least two casings to individually hold and at least partially enclose a corresponding one of the at least two cleaning brush rollers, wherein multiple sub-units include the casings and the cleaning brush rollers; and a sub-unit holder to hold the multiple sub-units, from which the sub-units are individually removable and into which a new sub-unit is installable, after a corresponding one of the multiple sub-units is removed.

7. The image forming device of claim 6, wherein the cleaning device further comprises:

another cleaning member arranged in the direction of movement of the cleaning target to remove the adhered substances from the cleaning target; and a third casing to individually hold and at least partially enclose the another cleaning member, the third casing and the another cleaning member together constituting a third sub-unit, wherein the sub-unit holder hold the multiple sub-units including the third subunit which is individually removable.

8. The cleaning device according to claim 7, wherein:

the another cleaning member is a cleaning brush roller.

* * * * *